United States Patent [19]

Nakajima et al.

[11] Patent Number: 5,019,185

[45] Date of Patent: May 28, 1991

[54] METHOD FOR PRODUCING HIGH STRENGTH CU-NI-SN ALLOY CONTAINING MANGANESE

[75] Inventors: Takashi Nakajima; Kenji Kubozono; Toshihiko Mori, all of Sagamihara; Takefumi Ito; Kimio Hashitsume, both of Amagasaki; Shinichi Iwase, Sagamihara, all of Japan

[73] Assignee: Mitsubishi Denki Kabushiki Kaisha, Tokyo, Japan

[21] Appl. No.: 436,737

[22] Filed: Nov. 15, 1989

[30] Foreign Application Priority Data

Nov. 15, 1988 [JP] Japan ..... 63-288044
Sep. 11, 1989 [JP] Japan ..... 1-235421

[51] Int. Cl.[5] ..... C22C 9/02; C21D 1/00

[52] U.S. Cl. ..... 148/13.2; 148/11.5 C; 420/488; 420/492

[58] Field of Search ..... 148/11.5 C, 13.2; 420/488, 492

[56] References Cited

U.S. PATENT DOCUMENTS

| | | | |
|---|---|---|---|
| 4,012,240 | 3/1977 | Hinrichsen et al. | 148/11.5 C |
| 4,052,204 | 10/1977 | Plewes | 148/13.2 |
| 4,142,918 | 3/1979 | Plewes | 148/11.5 C |
| 4,194,928 | 3/1980 | Popplewell et al. | 148/11.5 C |
| 4,601,879 | 7/1986 | Duerrschnabel et al. | 420/473 |
| 4,732,625 | 3/1988 | Livak | 148/11.5 C |

FOREIGN PATENT DOCUMENTS

| | | | |
|---|---|---|---|
| 0266049 | 11/1988 | Japan | 148/11.5 C |
| 0266055 | 11/1988 | Japan | 148/11.5 C |

*Primary Examiner*—Upendra Roy
*Attorney, Agent, or Firm*—Oblon, Spivak, McClelland, Maier & Neustadt

[57] ABSTRACT

A high strength Cu-Ni-Sn alloy, comprising 3–25% Ni, 3–9% Sn, 0.05–1.5% Mn, balance Cu, is heated to a temperature of 800° C. or above in a single-phase region. This heat treatment is followed by quenching and subsequent heating at a temperature range of 600°–770° C. in a two-phase region, followed by quenching and a finishing process with a ratio of 0–60%. Thereafter, the processed alloy is subjected to a final heat-treatment at a temperature of 350°–500° C.

2 Claims, No Drawings

METHOD FOR PRODUCING HIGH STRENGTH CU-NI-SN ALLOY CONTAINING MANGANESE

BACKGROUND OF THE INVENTION

1. Field of the Invention

This invention relates to a method for producing high strength copper alloy having excellent fatigue property, and heat-resistance property as well as favorable shaping property, hence it is suitable as the material for manufacturing electronic parts of wide varieties such as switches, relays, connectors, and so forth.

2. Discussion of Background

Heretofore, for the abovementioned electronic parts, beryllium copper (JIS C1720) and phosphor bronze (JIS C5210, C5191, and others) have been much used.

Since beryllium copper has high mechanical strength, excellent fatigue property, and a relatively favorable heat-resistant property, it has been used as the material for manufacturing high quality springs. On the other hand, phosphor bronze has been used widely as the material for general purpose springs, since it has inferior performance than those of beryllium copper.

However, beryllium copper has its disadvantage in that beryllium (Be) as the principal component for the alloy is very expensive, hence such expensive alloy component would inevitably reflect on the manufacturing cost of the product. On the other hand, phosphor bronze is considerably inferior to beryllium copper in respect of its fatigue property and other mechanical properties, even though it is relatively cheaper than beryllium copper.

The alloy according to the present invention composed of Cu-Ni Sn as the basic components is highlighted as the age-hardening alloy of spinodal decomposition type having high mechanical strength On account of its superiority in its static strength, the alloy has been used widely in the field of electronic parts as represented by connectors, etc.. In respect of its fatigue property, however, the alloy was at a level not so much different from the conventional phosphor bronze, hence it was not necessarily suitable as the material for various mechanical parts represented by switches, relays, etc., on which repreated stress is imposed.

The present inventor proposed in Japanese Patent Application No. 100793/1987 a method for heat-treatment, by which the abovementioned fatigue property is remarkably improved. While the fatigue property could be improved with great stride, however, there arose considerable decrease in respect of its shaping property and static strength with the consequent inability to have its excellent properties in every aspect of its properties.

SUMMARY OF THE INVENTION

The present invention has been made with a view to solving various problems inherent in the abovementioned Cu-Ni-Sn alloy, and aims at providing an improved method for producing high strength Cu-Ni-Sn alloy having both static and dynamic strengths at their excellent degree as well as favorable shaping property.

According to the present invention, in one aspect of it, there is provided a method for producing a high strength Cu-Ni-Sn alloy, which comprises: subjecting an alloy composed, by a weight ratio, of 3 to 25% of Ni, 3 to 9% of Sn, 0.05 to 1.5% of Mn, and a balance of Cu and unavoidable impurities to heat-treatment at a temperature of 800° C. or above, in a single phase region, followed by quenching the thus heat-treated alloy; subsequently subjecting said alloy to further heat-treatment at a temperature ranging from 600° to 770° C. in a two-phase region, followed by quenching the thus heat-treated alloy; subjecting said alloy to a finishing process with a processing ratio of from 0 to 60%; and thereafter subjecting the thus processed alloy to a final heat-treatment at a temperature of from 350° to 500° C. for a period of from 3 to 300 minutes (Production Method 1).

According to the present invention, in another aspect of it, there is provided a method for producing a high strength Cu-Ni-Sn alloy, which comprises: subjecting an alloy composed, by a weight ratio, of 3 to 25% of Ni, 3 to 9% of Sn, 0.05 to 1.5% of Mn, 0.01 to 0.8% in total of at least one kind of the elements selected from the group consisting of Si, Mg, Al, Co, Fe, Ti, Cr, P, Zn and B, and a balance of Cu and unavoidable impurities to heat-treatment at a temperature of 800° C. or above, in a single phase region, followed by quenching the thus heat-treated alloy; subsequently subjecting said alloy to further heat-treatment at a temperature ranging from 600° to 770° C. in a two-phase region, followed by quenching the thus heat-treated alloy; subjecting said alloy to a finishing process with a processing ratio of from 0 to 60%; and subjecting the thus processed alloy to a final heat-treatment at a temperature of from 350° to 500° C. for a period of from 3 to 300 minutes (Production Method 2).

The foregoing objects, other objects as well as specific process steps and treatment conditions according to the present invention will become more apparent and understandable from the following detailed description thereof, when read in connection with preferred examples thereof.

DETAILED DESCRIPTION OF PREFERRED EMBODIMENT

As for the content of each constituent element of the alloy according to the present invention, the following definition is given. The lower limit value thereof is defined by the minimum range of each constituent element to be added together, with which the expected effect of the present invention can be attained. On the other hand, the upper limit value of nickel (Ni) and tin (Sn) as the principal components is defined by a range of their combination, with which the remarkable age-hardening property of the alloy due to the spinodal decomposition is exhibited. As for the upper limit value of manganese (Mn), it is defined by such a level that its addition in excess of the upper limit value would cause considerable decrease in the electrical conductivity of the alloy without attaining remarkable improvement in its mechanical strength. As for other secondary component elements, they are added for the purpose of improving the heat-resistant property as well as further improvement in the mechanical strength of the alloy. While the effect of their addition becomes conspicuous as their adding quantities increase, if their adding quantities exceed the upper limit values, the molding property and the processability of the material become deteriorated along with decreases in the shaping property and the electrical conductivity of the material. The upper limit values of each constituent element has therefore been defined by taking the abovementioned factors into consideration.

The heat-treatment prior to the finishing process is for adjusting the micro-structure of the alloy. In order to improve the fatigue property of the alloy without impairment of its shaping property, the alloy is first subjected to the heat-treatment at a temperature of 800° C. in a single phase region, and then it is quenched; subsequently the alloy is again subjected to the heat-treatment at a temperature ranging from 600° to 770° C., where two phases become equilibrated in a equilibrium diagram, so that the second phase may be able to emerge at a room temperature, and then it is quenched. By the heat-treatment in the latter-mentioned two-phase region, it is possible to obtain the two-phase state even below 600° C. However, such low heating temperature would inevitably invite lowering in the shaping property of the alloy at a later stage and the age-hardening property thereof. On the other hand, the heat-treatment at a temperature exceeding 770° C. would considerably decrease the quantity of emergence of the second phase, because such high temperature level is very close to the side of the single phase region, with the consequent deterioration in the fatigue property of the alloy due to considerable decrease in the emerging quantity of the second phase. For the abovementioned reason, the temperature range for the second heat treatment is set in the abovementioned range.

As for a ratio of the ultimate finishing process of the product, it is set at 60% at the maximum in consideration of the shaping property of the alloy. The age-hardening treatment following the ultimate finishing process is to expect improvement in various properties of the product due to the age-hardening. If it is below 350° C., the age-hardening is not satisfactory; while a temperature exceeding 500° C. would cause inappropriate softening of the alloy due to excessive aging. Moreover, even if the age-hardening is effected in the above-defined temperature range, no satisfactory result can be obtained with a treatment time not reaching three minutes; on the other hand, an excessively long hours of treatment exceeding 300 minutes would cause saturation in the age-hardening phenomenon, which gives no merit at all. For the abovementioned reasons, and from the standpoint of industrialized production, both these shorter and longer treatment time have been excluded from the treatment conditions as being unsuitable for the purpose.

In the method for production of high strength copper alloy according to the present invention, the processed structure existing in the material to be processed is caused to disappear completely by the solution-heat-treatment at a temperature above 800° C. in the single phase region, and then, by the quasi-solution-heat-treatment at a temperature ranging from 600° to 770° C., at which the two-phase region is obtained, a structure is formed, wherein the second phase is uniformly dispersed in the matrix (first phase) in normal temperature condition. By the combination of these two heat-treatment stages, it is possible to form the base body having excellent static and dynamic strength, without imparing its shaping property, and to age-harden the thus obtained base body by the final heat-treatment at a temperature range of from 350° to 500° C., thereby producing the high strength copper alloy having excellent characteristics required of it, in the well-balanced state.

With a view to enabling those persons skilled in the art to put the present invention into practice, the following preferred examples are presented. It should be noted that the invention is not limited to these examples alone, but any changes and modifications may be made without departing from the spirit and scope of the invention as recited in the appended claims.

Table 1 to appear below indicates in comparison the compositions and characteristics of the high strength copper alloy according to the preferred examples of the present invention and comparative examples.

Of alloys having various compositions of Specimens No. 1 through No. 24 shown in Table 1, the Specimens No. 1 to No. 18 were heat-treated for 45 minutes at a temperature of 820° C., followed by quenching the same, and then they were further heat-treated for 45 minutes at 700° C., followed by quenching. As for the Specimens No. 19, No. 22, and No. 23, they were heat-treated for 45 minutes at 700° C., followed by quenching the same, and, as for the Specimens No. 20, No. 21, and No. 24, they were heat-treated for 45 minutes at 820° C., followed by quenching the same. Thereafter, these specimen alloys were finished with their respective finish-processing ratio, as shown in Table 1 below, and then they were subjected to the aging treatment as follows: two hours at 375° C. for the Specimens Nos. 1, 3 to 16, and 19 to 21; and two hours at 450° C. for the Specimens Nos. 2, 17, 18, 22 to 24. The characteristics of these specimens after the aging treatment are as shown in Table 1.

From the results shown in Table 1 below, it will be seen that, when comparing the Specimens Nos. 3 to 5, 7, 8, and 10 to 15 with the Specimens Nos. 9, 17, and 18, high hardness could be obtained with the alloys according to the present invention, to which manganese (Mn) and the secondary components such as silicon (Si), magnesium (Mg), aluminum (Al), and so forth had been added, without imparing the electrical conductivity thereof. Moreover, the Specimen No. 6 containing therein manganese in a quantity exceeding the predetermined quantity and the Specimen No. 16 containing therein the secondary components in quantities exceeding the predetermined quantities indicate that hardness of these alloys are in a saturated condition, and the electrical conductivity and the shaping property are recognized to have been lowered. Based on these findings, therefore, these specimens were excluded from the scope of the present invention as being non-conformable to the purpose of the present invention.

As for the heat-treating conditions, upon comparison of the respective specimens Nos. 4, 10 and Nos. 9, 17 according to the examples of the present invention with the Specimens Nos. 19, 20, 21 and Nos. 22, 23, 24, it was found that the stress-relaxing property and the shaping property of the Specimens Nos. 19, 22 and 23 were considerably inferior to those of the specimens according to the present invention. With the Specimens Nos. 20, 21 and 24 of the comparative examples, the stress limit of the fatigue strength ($10^7$ times of repeated contact operation) at the target standard was found as low as the level of the Specimen No. 26 of the comparative example (JIS C5210).

To sum up of the nature of the alloy material produced by the method of the present invention, it can possess, at the same time, both stress-relaxing property and the fatigue property at their excellent levels, without spoiling the mechanical strength, the electrical conductivity, and the shaping property. The improvement in the hardness, the stress-relaxing property and the fatigue property of the alloy could be achieved by the addition of manganese (Mn) and the secondary components such as silicon (Si), magnesium (Mg), aluminum (Al), and so forth, without imparing the electrical conductivity and the shaping property thereof.

TABLE 1

| Specimen | Composition Ni | Sn | Mn | Secondary component | Cu | Processing conditions: Heat treatment | Ratio of finishing |
|---|---|---|---|---|---|---|---|
| 1 | 9.03 | 6.28 | — | — | Balance | 820° C. × 45 min.quenching → 700° C. × 45 min.quenching | 12% |
| 2 | 20.18 | 5.06 | — | | | 820° C. × 45 min.quenching → 700° C. × 45 min.quenching | 12% |
| 3 | 9.03 | 6.27 | 0.08 | — | Balance | 820° C. × 45 min.quenching → 700° C. × 45 min.quenching | 12% |
| 4 | 9.02 | 6.26 | 0.40 | — | Balance | 820° C. × 45 min.quenching → 700° C. × 45 min.quenching | 12% |
| 5 | 9.02 | 6.28 | 1.32 | — | Balance | 820° C. × 45 min.quenching → 700° C. × 45 min.quenching | 12% |
| 6 | 9.03 | 6.27 | 1.81 | — | | 820° C. × 45 min.quenching → 700° C. × 45 min.quenching | 12% |
| 7 | 9.02 | 6.27 | 0.41 | — | Balance | 820° C. × 45 min.quenching → 700° C. × 45 min.quenching | 0% |
| 8 | 9.03 | 6.28 | 0.41 | — | Balance | 820° C. × 45 min.quenching → 700° C. × 45 min.quenching | 40% |
| 9 | 20.16 | 5.07 | 0.42 | — | Balance | 820° C. × 45 min.quenching → 700° C. × 45 min.quenching | 12% |
| 10 | 9.02 | 6.27 | 0.41 | Si 0.22 | Balance | 820° C. × 45 min.quenching → 700° C. × 45 min.quenching | 12% |
| 11 | 9.02 | 6.28 | 0.40 | Al 0.41 | Balance | 820° C. × 45 min.quenching → 700° C. × 45 min.quenching | 12% |
| 12 | 9.03 | 6.26 | 0.41 | Ti 0.16, Fe 0.27 | Balance | 820° C. × 45 min.quenching → 700° C. × 45 min.quenching | 12% |
| 13 | 9.02 | 6.27 | 0.41 | Cr 0.08, Zn 0.11 | Balance | 820° C. × 45 min.quenching → 700° C. × 45 min.quenching | 12% |
| 14 | 9.02 | 6.27 | 0.40 | Mg 0.33, P 0.09, B 0.02 | Balance | 820° C. × 45 min.quenching → 700° C. × 45 min.quenching | 12% |
| 15 | 9.03 | 6.27 | 0.41 | Co 0.19, Zn 0.30, Al 0.30 | Balance | 820° C. × 45 min.quenching → 700° C. × 45 min.quenching | 12% |
| 16 | 9.03 | 6.27 | 0.40 | Co 0.22, Si 0.36, Al 0.10 Zn 0.28 | Balance | 820° C. × 45 min.quenching → 700° C. × 45 min.quenching | 12% |
| 17 | 20.16 | 5.07 | 0.39 | Si 0.18, Mg 0.24, P 0.07 | Balance | 820° C. × 45 min.quenching → 700° C. × 45 min.quenching | 12% |
| 18 | 20.16 | 5.08 | 0.40 | Fe 0.14, Ti 0.02, Co 0.09 Cr 0.09 | Balance | 820° C. × 45 min.quenching → 700° C. × 45 min.quenching | 12% |
| 19 | 9.03 | 6.27 | 0.41 | — | Balance | 700° C. × 45 min.quenching | 12% |
| 20 | 9.02 | 6.28 | 0.41 | — | Balance | 820° C. × 45 min.quenching | 12% |
| 21 | 9.02 | 6.27 | 0.42 | Si 0.23 | Balance | 820° C. × 45 min.quenching | 12% |
| 22 | 20.18 | 5.06 | 0.41 | — | Balance | 700° C. × 45 min.quenching | 12% |
| 23 | 20.18 | 5.06 | 0.40 | Si 0.17, Mg 0.23, P 0.09 | Balance | 700° C. × 45 min.quenching | 12% |
| 24 | 20.18 | 5.06 | 0.41 | — | Balance | 820° C. × 45 min.quenching | 12% |
| 25 | JIS C1720-1/4HT | | | | | — | — |
| 26 | JIS C5210-H | | | | | — | — |

| Specimen | Hardness ($H_v$5) | Electrical conductivity (% IASS) | Fatigue strength (at $10^7$ times kgf/mm$^2$) | Shaping property (R/t) | Stress relaxing ratio (ad.$\sigma$a: 30 kgf/mm$^2$ 150 × 45 Hr) | Remarks |
|---|---|---|---|---|---|---|
| 1 | 305 | 14 | 37 | 0.5 | 6.6 | Comparative Example |
| 2 | 312 | 7 | 37 | 0.5 | 2.7 | Comparative Example |
| 3 | 308 | 14 | 37 | 0.5 | 6.3 | Example |
| 4 | 314 | 14 | 38 | 0.5 | 6.2 | Example |
| 5 | 338 | 12 | 38 | 0.5 | 6.0 | Example |
| 6 | 339 | 10 | 38 | 2.0 | 6.0 | Comparative Example |
| 7 | 314 | 14 | 38 | 0.5 | 5.8 | Example |
| 8 | 315 | 14 | 40 | 1.0 | 6.4 | Example |
| 9 | 318 | 7 | 38 | 0.5 | 2.5 | Example |
| 10 | 317 | 14 | 38 | 0.5 | 6.0 | Example |
| 11 | 320 | 13 | 38 | 0.5 | 5.9 | Example |
| 12 | 324 | 13 | 38 | 0.5 | 5.9 | Example |
| 13 | 310 | 14 | 38 | 0.5 | 5.0 | Example |
| 14 | 331 | 12 | 39 | 0.5 | 5.9 | Example |
| 15 | 333 | 12 | 39 | 0.5 | 5.8 | Example |
| 16 | 338 | 10 | 39 | 2.0 | 5.8 | Comparative Example |
| 17 | 331 | 7 | 38 | 0.5 | 2.2 | Example |
| 18 | 326 | 7 | 38 | 0.5 | 2.3 | Example |
| 19 | 303 | 13 | 38 | 5.0 | 20.5 | Comparative Example |
| 20 | 344 | 14 | 30 | 0.5 | 6.1 | Comparative Example |
| 21 | 318 | 14 | 30 | 0.5 | 5.9 | Comparative Example |
| 22 | 314 | 6 | 38 | 5.0 | 7.6 | Comparative Example |
| 23 | 322 | 6 | 38 | 6.0 | 7.4 | Comparative Example |
| 24 | 349 | 7 | 30 | 0.5 | 2.4 | Comparative Example |
| 25 | 386 | 25 | 40 | 0.5 | 7.2 | Comparative Example |
| 26 | 203 | 11 | 27 | 0.5 | 14.3 | Comparative Example |

As has so far been described in the foregoing, the method for producing the copper alloy according to the present invention makes it possible to produce the copper alloy material having favorable electrical conductivity and shaping property, and being excellent in its fatigue property and stress-relaxing property, by first adding manganese (Mn) and the secondary components such as silicon (Si), magnesium (Mg), aluminum (Al), and so on to the age-hardening Cu-Ni-Sn alloy of the spinodal decomposition type, with a view to improving its mechanical strength; then subjecting the alloy to heat-treatment in a single phase region, followed by quenching the same; thereafter subjecting the alloy to further heat treatment in a two-phase region, followed by quenching the same; subjecting the thus heat-treated alloy to the finishing process at a finishing ratio of from 0 to 60%; and finally subjecting the thus finished product to heat-treatment at a temperature of from 350° to 500° C. for a period of from 3 to 300 minutes.

What is claimed is:

1. A method for producing a high strength Cu-Ni-Sn alloy, which consist essentially of:

subjecting an alloy composed, by a weight ratio, of 3 to 25% of Ni, 3 to 9% of Sn, 0.05 to 1.5% of Mn, and a balance of Cu and unavoidable impurities to heat-treatment at a temperature of 800° C. or above, in a single phase region, followed by quenching the thus heat-treated alloy;

subsequently subjecting said alloy to further heat-treatment at a temperature ranging from 600° to 770° C. in a two-phase region, followed by quenching the thus heat-treated alloy;

subjecting said alloy to a finishing process with a processing ratio of from 0 to 60%; and thereafter subjecting the thus processed alloy to a final heat-treatment at a temperature of from 350° to 500° C. for a period of from 3 to 300 minutes.

2. A method for producing a high strength Cu-Ni-Sn alloy, which consisting essentially of:

subjecting an alloy composed, by a weight ratio, of 3 to 25% of Ni, 3 to 9% of Sn, 0.05 to 1.5% of Mn, 0.01 to 0.8% in total of at least one kind of the elements selected from the group consisting of Si, Mg, Al, Co, Fe, Ti, Cr, P, Zn and B, and a balance of Cu and unavoidable impurities to heat-treatment at a temperature of 800° C. or above, in a single phase region, followed by quenching the thus heat-treated alloy;

subsequently subjecting said alloy to further heat-treatment at a temperature ranging from 600° to 770° C. in a two-phase region, followed by quenching the thus heat-treated alloy;

subjecting said alloy to a finishing process with a processing ratio of from 0 to 60%; and thereafter subjecting the thus processed alloy to a final heat-treatment at a temperature of from 350° to 500° C. for a period of from 3 to 300 minutes.

* * * * *